US011490216B2

(12) United States Patent
Strelcyk

(10) Patent No.: US 11,490,216 B2
(45) Date of Patent: Nov. 1, 2022

(54) COMPENSATING HIDDEN HEARING LOSSES BY ATTENUATING HIGH SOUND PRESSURE LEVELS

(71) Applicant: SONOVA AG, Staefa (CH)

(72) Inventor: Olaf Strelcyk, Cincinnati, OH (US)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/150,652

(22) Filed: Jan. 15, 2021

(65) Prior Publication Data

US 2021/0227340 A1 Jul. 22, 2021

(30) Foreign Application Priority Data

Jan. 17, 2020 (EP) ..... 20152367

(51) Int. Cl.
*H04R 25/00* (2006.01)

(52) U.S. Cl.
CPC ..... *H04R 25/70* (2013.01); *H04R 25/353* (2013.01); *H04R 25/505* (2013.01); *H04R 2225/43* (2013.01)

(58) Field of Classification Search
CPC ..... H04R 25/00; H04R 25/60; H04R 25/65; H04R 2225/49; H04R 2460/01
USPC ..... 381/312–331
See application file for complete search history.

(56) References Cited

U.S. PATENT DOCUMENTS

2013/0103396 A1* 4/2013 Swanson ..... G10L 21/034 704/225
2016/0199643 A1* 7/2016 Segovia Martinez ..... A61N 1/36038 607/57
2017/0245064 A1 8/2017 Damsgaard
2021/0019109 A1* 1/2021 Smith ..... H04R 1/1041

FOREIGN PATENT DOCUMENTS

EP 3045204 7/2016
WO 2017137344 8/2017
WO 2017143333 8/2017

OTHER PUBLICATIONS

Extended European Search Report received in EP Application No. 20152367.7 dated Mar. 25, 2020.
Bess, et al., Performance Intensity Functions in Cochlearand Eight Nerve Disorders, American Journal of Otolaryngology, vol. 1, No. 1, Jul. 1979.

(Continued)

*Primary Examiner* — Suhan Ni
(74) *Attorney, Agent, or Firm* — ALG Intellectual Property, LLC

(57) ABSTRACT

A method for compensating hearing deficiencies with a hearing device includes receiving a sound signal; attenuating an output sound pressure level of the sound signal dependent on an input sound pressure level of the sound signal; and outputting the attenuated sound signal with a loudspeaker of the hearing device; wherein the output sound pressure level is attenuated, when the input sound pressure level is above an upper speech recognition kneepoint of a user, which (Continued)

upper speech recognition kneepoint is stored in the hearing device and which has been selected dependent on a sound pressure level dependent speech recognition ability of the user.

13 Claims, 2 Drawing Sheets

(56) References Cited

OTHER PUBLICATIONS

Furman, et al., Noise-induced Cochlear Neuropathy is Selective for Fibers With Low Spontaneous Rates, J. Neurophysiol 110: 577-586, 2013.
Gatehouse, et al., The Speech, Spatial and Qualities of Hearing Scale (SSQ), International Journal of Audiology 2004; 43:85-99.
Guest, et al., The Noise Exposure Structured Interview (NESI): An Instrument for the Comprehensive Estimation of Lifetime Noise Exposure, Trends in Hearing, vol. 22:1-10.
Noish, Occupational Noise Exposure, CDC Criteria For A Recommended Standard, U.S Department of Health and Human Services. Revised Criteria 1998.

* cited by examiner

COMPENSATING HIDDEN HEARING LOSSES BY ATTENUATING HIGH SOUND PRESSURE LEVELS

RELATED APPLICATIONS

The present application claims priority to EP Patent Application No. 20152367.7, filed Jan. 17, 2020, the contents of which are hereby incorporated by reference in their entirety.

BACKGROUND INFORMATION

There are persons, who have normal pure-tone hearing thresholds but who experience difficulties in understanding speech. In addition to near-normal audiograms, such persons may meet one or more of the following criteria (here and in the following "normal" may refer to a reference group of young listeners with clinically normal audiograms without tinnitus or complaints about difficulties understanding speech). They may experience tinnitus. They may experience greater difficulties with speech-in-noise understanding than same-age peers, as can be quantified in terms of questionnaires. They may show a weaker-than-normal ipsilateral or contralateral wideband middle ear muscle reflex. They may have experienced noise exposure beyond recommended exposure limits. They may show poorer-than-normal speech recognition performance or speech-in-noise recognition performance at high speech presentation levels such as levels above 90 dBA. They may show declining speech recognition performance or speech-in-noise recognition performance with increasing speech presentation level, i.e. so called speech rollover. They may show auditory brainstem response wave I or wave V amplitudes or latencies or ratios of wave I to wave V amplitudes deviating from a normal population. They may show results deviating from normal in any of the following tests: amplitude-modulation detection or discrimination, frequency modulation detection, interaural phase difference discrimination, interaural level difference discrimination, and intensity discrimination. In general, such symptoms may reflect a so-called hidden hearing loss.

WO 2017143333 A1 describes a signal processing strategy in a hearing aid, which compensates for hidden hearing loss, i.e., diminished ability to distinguish speech in the presence of noise notwithstanding normal pure-tone response as measured by standard hearing tests. The signal is processed frequency-dependent in different bands to compensate the hearing loss.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
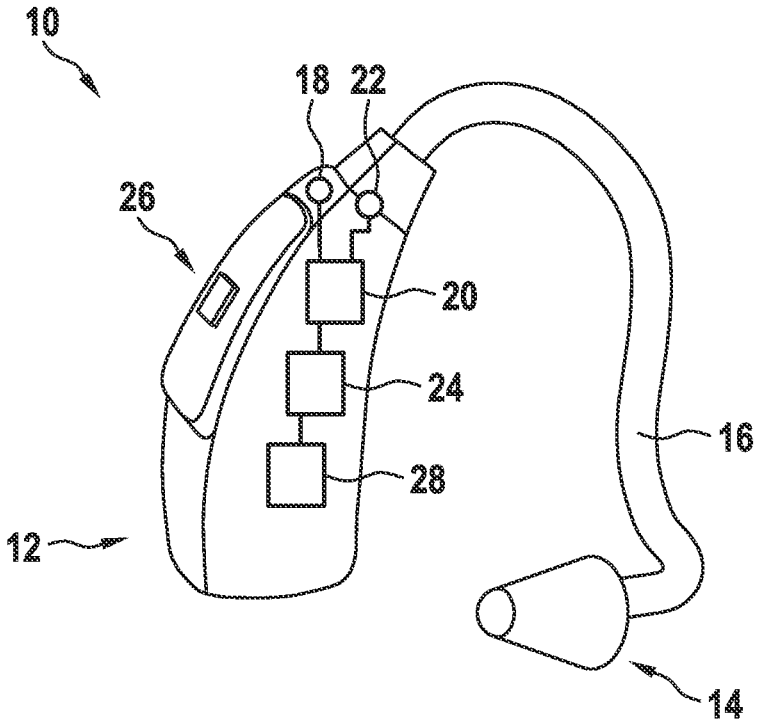
FIG. 1 schematically shows a hearing device according to an embodiment.

Described herein are a method, a computer program and a computer-readable medium for compensating hearing deficiencies with a hearing device. Furthermore, the embodiments described herein relate to a hearing system with a hearing device.

Above listed persons may experience the difficulties due to hidden supra-threshold deficits, i.e., deficits in the auditory processing of sounds at high sound pressure levels. However, current hearing aids usually amplify sound at high input levels and may aggravate rather than alleviate the problems experienced by these users.

The embodiments described herein may increase speech intelligibility and perceived sound quality for hearing device users, who experience hearing difficulties despite having normal or near-normal audiograms.

This is achieved by the subject-matter of the independent claims. Further exemplary embodiments are evident from the dependent claims and the following description.

A first aspect relates to a method for compensating hearing deficiencies with a hearing device. A hearing device may be a hearing aid adapted for compensating a hearing loss of the user, who may wear the hearing device. Such hearing devices are generally small and complex devices. Hearing devices can include a processor, microphone, speaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices.

A hearing device also may be a consumer electronics device adapted for sound processing. A hearing device may additionally provide mild gain and/or noise reduction, beamforming and/or tinnitus masking to assist the user. It has to be noted that everything herein what refers to a hearing device also may refer to a pair of hearing devices, which were worn by the user.

According to an embodiment, the method comprises: receiving a sound signal; attenuating an output sound pressure level of the sound signal dependent on an input sound pressure level of the sound signal; and outputting the attenuated sound signal with a loudspeaker of the hearing device. The method may be automatically performed by the hearing device.

The sound signal may be generated by a microphone of the hearing device and/or may encode environmental sound of the user. However, it also is possible that the sound signal is received in the hearing device via a wireless communication link, such as Bluetooth. For example, the sound signal may be received from a mobile device, such as a Smartphone, of the user.

The hearing device may comprise a sound processor adapted for adjusting the sound signal with respect to a sound pressure level. The sound pressure level may be provided in dB. Attenuation of the sound signal may mean that an input sound level is higher than an output sound pressure level. Attenuation may be performed by multiplying the sound pressure level with a factor smaller than 1. The attenuation is input sound pressure level dependent, which may mean that sound signals of different input sound pressure levels are attenuated with different factors.

The loudspeaker (also called receiver) of the hearing device may generate sound, which is directed in the ear canal of the user. For example, the loudspeaker or an end of a tube connected to the loudspeaker may be arranged in the ear canal of the user.

According to an embodiment, the output sound pressure level is attenuated, when the input sound pressure level is above an upper speech recognition kneepoint of the user, which upper speech recognition kneepoint is stored in the hearing device and which has been selected dependent on a sound pressure level dependent speech recognition ability of the user. The upper speech recognition kneepoint may be seen as an upper threshold.

When an input sound level higher than the upper speech recognition kneepoint is detected, the output sound level of the sound signal may be lowered. The detection may be performed by a sound processor of the hearing device, which is adapted to analyze the sound signal. The upper speech recognition kneepoint may be a value and/or quantity stored in the hearing device, which may have been set in the hearing device dependent on the hearing deficiencies of the user. For example, a hearing care specialist, which has determined the specific speech recognition problems of the user, may set the upper speech recognition kneepoint.

Users with normal or near-normal (mild hearing loss) audiograms may benefit from the method. Although parts of the sound signal are attenuated, they may understand speech better since their hearing loss may be based on deficiencies with respect to high sound pressure levels. It has to be noted, however, that the method is not limited to this group of users. Users with more severe hearing losses may also benefit from the method.

It has to be noted that the hearing device may comprise an in-the-ear part, which is adapted for completely or nearly completely occluding the ear canal of the user, such that direct environmental sound, which may have high sound pressure levels, is prevented from reaching the tympanic membrane or eardrum of the user.

According to an embodiment, the output sound pressure level is attenuated above a sound pressure level threshold, which sound pressure level is stored in the hearing device and which has been selected smaller than the upper speech recognition kneepoint.

The sound pressure level threshold may be smaller than the upper speech recognition kneepoint, such as 50% to 90% of the upper speech recognition kneepoint. In such a way, the attenuation already may start at sound pressure levels below the upper speech recognition kneepoint.

In general, there may be one or more parameters stored in the hearing device, which define the attenuation of the sound signal at different input sound pressure levels. With these parameters, an attenuation curve in the hearing device may be set.

According to an embodiment, an attenuation of the output sound pressure level between the sound pressure level threshold and the upper speech recognition kneepoint is continuously increasing. The term "continuously" may mean that there are no jumps in the attenuation curve defined by an attenuation factor applied to the input sound pressure level. In other words, an attenuation factor between the sound pressure level threshold and the upper speech recognition kneepoint may be continuously decreasing. The attenuation factor, which may be multiplied to the input sound pressure level, may be a number between 0 and 1 indicating the amount of attenuation. A factor of 1 indicates no attenuation at all, while a factor of 0 indicates complete attenuation, i.e. the sound signals is not present any more. It may be that the attenuation factor is 1 at the sound pressure level threshold.

According to an embodiment, the sound signal at a maximal sound pressure level is attenuated to the upper speech recognition kneepoint. In such a way, the person for which the hearing device has been fitted can hear all sounds up to the maximal sound pressure level without hearing problems. The maximal sound pressure level may be a parameter dependent of the hearing device. The maximal sound pressure level may be seen as a maximum expected input level.

According to an embodiment, below the sound pressure level threshold, the output sound signal is attenuated by at least 10%. When the input sound pressure level is below the sound pressure level threshold, it may be that the sound signal is not or nearly not attenuated at all. Therefore, it also may be that an attenuation level of the output sound signal below the sound pressure level threshold is equal to 1.

In other words, there may be a transparent audio reproduction at low and mid sound pressure levels at least up to the sound pressure level threshold without objectionable occlusion. Among other factors, transparent audio reproduction may be achieved by providing zero insertion gain and high-quality audio reproduction including full spatial cues.

It also may be that the hearing device provides other sound signal processing below and/or above the sound pressure level threshold, such as feedback cancellation, wind-noise cancellation. There also may be features such as Bluetooth connectivity for audio streaming and/or control via connected devices.

According to an embodiment, the upper speech recognition kneepoint is the lowest sound pressure level at which the user has hearing deficiencies in hearing speech. The upper speech recognition kneepoint may be determined by performing a test with the hearing device user. This test may include presenting the user speech at different sound pressure levels. The test may be performed by a hearing care specialist and/or by the hearing device.

According to an embodiment, the upper speech recognition kneepoint is the lowest sound pressure level at which the user has hearing deficiencies in hearing speech, multiplied by a factor of 0.8 to 1.2.

According to an embodiment, the upper speech recognition kneepoint is higher than 75 dB or higher than 85 dB. This may indicate that the user has a hidden hearing loss, which may be present solely at high sound pressures.

According to an embodiment, the upper speech recognition kneepoint is frequency-dependent. The upper speech recognition kneepoint may be set in dependence of the sound pressure level of different frequency bands of the input sound signal. It may be that values for an upper speech recognition kneepoint are stored for different frequencies and/or frequency bands in the hearing device.

According to an embodiment, the attenuation of the sound signal is additionally frequency-dependent. In other words, the hearing device may divide the sound signals into different frequency bands and may attenuate these frequency bands differently. In each frequency band, an upper speech recognition level and/or sound pressure level threshold may be defined and/or stored in the hearing device and the attenuation may be performed with respect to these quantities in every frequency band.

According to an embodiment, the sound signal is at least one of frequency lowered, compressed and translated above the upper speech recognition kneepoint and/or above the sound pressure level threshold. Additionally, it also may be that frequencies with sound pressure levels above these quantities are modified in a different way. Frequency lowering may refer to decreasing frequency in a frequency band. Frequency compressing may refer to shrinking a frequency band. Frequency translation may refer to moving frequencies from one frequency band into another band.

According to an embodiment, a strength of a wideband middle ear muscle reflex is measured, for example using ipsilateral and/or contralateral narrowband noise reflex elicitors and/or tonal reflex elicitors of varying center frequency. The strength of the middle ear muscle reflex may be indicative of a hidden hearing loss related to hearing deficiencies at high sound pressure levels. When the reflex is weak for specific high sound pressure levels, this may indicate such a problem. The middle ear muscle reflex may be measured by generating sound with a loudspeaker of the hearing device at different sound pressure levels, which sound is transmitted in the ear of the user, receiving a reflected sound signal reflected by the ear, and evaluating a sound pressure level of the reflected signal. As higher the amount of reflected sound, as stronger the middle ear muscle reflex may be assumed.

According to an embodiment, at least one of frequency lowering, frequency compression and frequency translation is adjusted dependent on the measured strength of the middle ear muscle reflex. If the strength of the middle ear muscle reflex is weaker than normal for one elicitor frequency and/or for a cluster of frequencies, frequency lowering and/or frequency compression and/or frequency translation is activated to present the information contained in these frequency bands at frequencies of normal middle ear muscle reflex strength.

Further aspects relate to a computer program for compensating hearing deficiencies with a hearing device, which, when being executed by a processor, is adapted to carry out the steps of the method as described in the above and in the following as well as to a computer-readable medium, in which such a computer program is stored.

For example, the computer program may be executed in a processor of a hearing device, which hearing device, for example, may be carried by the person behind the ear. The computer-readable medium may be a memory of this hearing device.

In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect relates to a hearing device. The hearing device may comprise a microphone for acquiring environmental sound of a user and for generating a sound signal; a sound processor for attenuating the sound signal at least dependent on an input sound pressure level of the sound signal; and a loudspeaker for outputting the attenuated sound signal to the user.

According to an embodiment, the hearing device may be adapted for performing the method as described in the above and in the following. For example, the hearing device may comprise a processor and the method may be implemented as software module in the hearing device.

It has to be understood that features of the method as described in the above and in the following may be features of the computer program, the computer-readable medium and the hearing device as described in the above and in the following, and vice versa.

These and other aspects will be apparent from and elucidated with reference to the embodiments described hereinafter.

FIG. 1 schematically shows a hearing device 10 in the form of a behind-the-ear device. It has to be noted that the hearing device 10 of FIG. 1 is a specific embodiment and that the method described herein also may be performed by other types of hearing devices, such as in-the-ear devices and/or hearables.

The hearing device 10 comprises a part 12 behind the ear and a part or coupling 14 to be put in the ear canal of a user. The part 12 and the coupling 14 are connected by a tube 16. In the part 12, a microphone 18, a sound processor 20, which may comprise an amplifier, and a sound output device 22, such as a loudspeaker and/or receiver, are provided. The microphone 18 may acquire environmental sound of the user and may generate a sound signal, the sound processor and/or amplifier 20 may amplify the sound signal and the sound output device 22 may generate sound that is guided through the tube 16 and the in-the-ear part 14 into the each canal of the user.

The hearing device 10 may comprise a processor 24, which is adapted for adjusting a sound pressure level and/or frequency-dependent gain of the sound processor 20. In particular, the output sound pressure level may be attenuated in dependence of the input sound pressure level as described herein. With a knob 26 of the hearing device 10, a user may select a specific program, which has been adjusted for him or by himself to compensate his hearing loss in a specific situation. These programs and/or the method as described herein may be implemented as one or more computer programs stored in a memory 28 of the hearing device 10, which computer programs may be executed by the processor 20.

Figure 2:
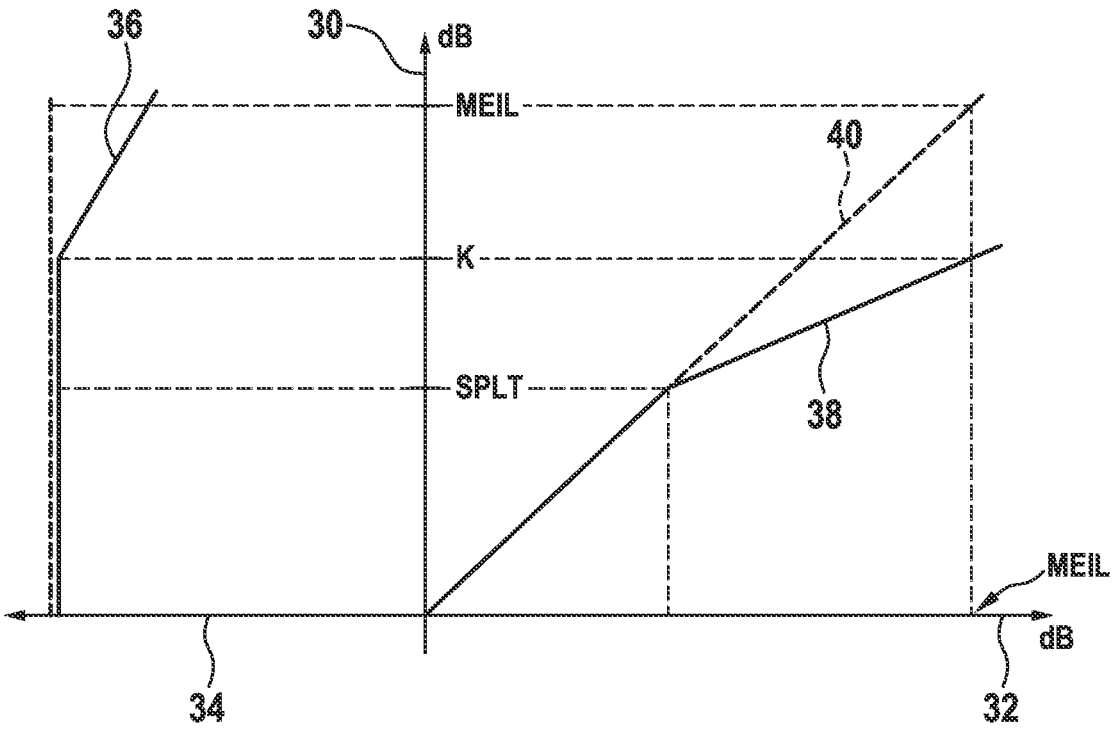
FIG. 2 shows a diagram with output sound pressure levels in dependence on input sound pressure levels as used in an embodiment.

FIG. 2 shows a diagram, in which an output sound pressure level 30 is depicted as vertical axis. On the horizontal axis to the right, an input sound pressure level 32 and to the left a speech score 34 of a user is depicted.

The speech score 34 describes a speech intelligibility of the user as a function of the output sound pressure level 30. As shown by the speech intelligibility curve 36, the user is able to hear speech below a speech recognition kneepoint K without impairment. The speech recognition kneepoint K may be a knee point of the speech intelligibility curve 36, where the speech score starts to decline with increasing output sound level 30.

Above the speech recognition kneepoint K, the speech intelligibility of the user becomes worse with increasing output sound pressure level. The speech intelligibility curve 36 may be determined with one or more tests, which may be performed by a hearing care specialist and/or the hearing device 10.

On the right hand side of the diagram, an attenuation curve 38 is shown. The dotted curve 40 shows an attenuation with an attenuation factor of 1. The attenuation curve 38 describes a function, which for a specific input sound pressure level 32 of an input signal attenuates the output sound pressure level 30 of an output signal. The attenuation curve 38 and/or support points of it may be stored as parameters in the hearing device 10. These parameters may be fitted by a hearing care specialist and/or may be adjusted by the user.

For the present user, below a sound pressure level threshold SPLT, the attenuation factor defined by the curve 38 is 1, i.e. no attenuation takes place. Above the sound pressure level threshold SPLT, the attenuation factor defined by the curve 38 is smaller than 1, i.e. attenuation takes place. The sound pressure level threshold SPLT may be a parameter set in the hearing device 10, which is chosen smaller than the speech recognition kneepoint K and/or which indicates a point above which the sound pressure level 30 is adjusted to compensate for the hearing deficiencies of the user.

In general, if the user shows speech rollover, i.e. declining speech recognition performance as indicated by the speech intelligibility curve 36, the attenuation curve 38 above the sound pressure level threshold SPLT and in particular above the speech recognition kneepoint K may be adjusted, such that there the attenuation factor applied to the input signal is smaller than 1. It has to be noted that the sound pressure level threshold SPLT and/or the speech recognition kneepoint K may well exceed levels of conversational speech.

To attenuate the output sound signal above the sound pressure level threshold SPLT, single-channel and/or multi-channel dynamic range compression and/or automatic gain control and/or output limiting circuits may be used. Time constants of the compressive circuit may be chosen to provide syllabic or slower compression. The sound pressure level threshold SPLT and optionally the compression time constants may be adjusted by the user according to personal preferences, for example by use of a mobile phone connected to the hearing device 10.

As shown in FIG. 2, the sound pressure level threshold SPLT may be set, such that the output levels up to a maximum expected input level MEIL will not exceed the speech recognition kneepoint K. The maximum expected input level MEIL may be defined as a maximal sound pressure level that is of relevance to the user and/or may depend on the hardware of the hearing device 10.

Depending on a pre-determined acceptable compression-ratio (CR), for example CR=2, and the maximum expected input level MEIL, for example 100 dB, the sound pressure level threshold SPLT may be set according to:

$$\mathrm{SPLT}=K-(\mathrm{MEIL}-K)/(CR-1)$$

In particular, this may prevent speech rollover for all input levels up to the maximum expected input level MEIL. It also may be that the compression ratio CR is adjusted by the user.

It also may be that the speech recognition kneepoint K as determined from the curve 36 is adjusted by a tolerance T, such as T=±10 dB, resulting in the parameter L:

$$L=K+T$$

The sound pressure level threshold then may be determined from $$\mathrm{SPLT}=L-(\mathrm{MEIL}-L)/(CR-1)$$

The tolerance T allows for more (or less) conservative sound processing, given the possibility of underestimated (or overestimated) speech rollover. It also may be that the tolerance T is adjusted by the user.

Figure 3:
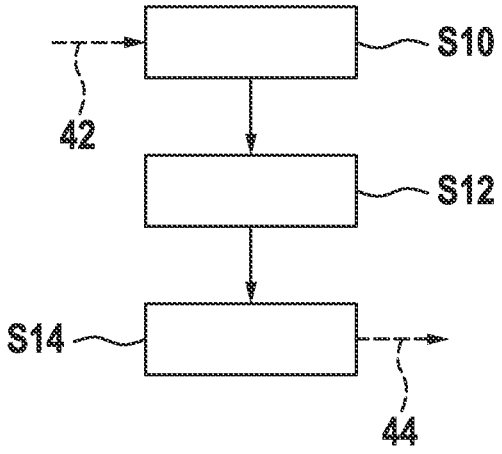
FIG. 3 shows a flow diagram for a method for compensating hearing deficiencies according to an embodiment.

FIG. 3 shows a flow diagram for a method for compensating hearing deficiencies with a hearing device 10.

In step S10, a sound signal 42 is received in the hearing device 10. For example, the microphone 18 converts an audio signal with environmental sound of the user into the sound signal 42. It also may be that the sound signal 42 is received in the hearing device 10 via a wireless communication protocol, for example from a Smartphone of the user.

In step S12, the received sound signal 42 is attenuated by the hearing device 10. The output sound pressure level 30 of the sound signal 42 may be attenuated dependent on an input sound pressure level 32 of the sound signal 42. In particular, the output sound pressure level 30 is attenuated, when the input sound pressure level 32 is above the upper speech recognition kneepoint K and in particular above the sound pressure level threshold SPLT.

As described above, both values K and SPLT may be stored in the hearing device 10, for example in the memory 28 and/or both values may have been selected dependent on a sound pressure level dependent speech recognition ability 36 of the user.

As shown in FIG. 2, an attenuation of the output sound pressure level 30 between the sound pressure level threshold SPLT and the upper speech recognition kneepoint K is continuously increasing. Furthermore, the sound signal 42 may be attenuated at the maximal sound pressure level MEIL, such that when the input sound pressure level is at the maximal sound pressure level MEIL, the output sound pressure level 30 is at the upper speech recognition kneepoint K.

In particular, the attenuation can be determined as described above with respect to the formulas for the SPLT and optionally the tolerance T.

Below the sound pressure level threshold SPLT, the sound signal 42 may be attenuated solely mildly or not at all. For example, below the sound pressure level threshold SPLT, the output sound signal 44 is attenuated by at least 10%. It also may be that the sound signal 42 is not attenuated at all. In this case, an attenuation factor of the output sound signal 44 below the sound pressure level threshold SPLT may be equal to 1.

It has to be noted that the parameters shown in FIG. 2 and in particular the upper speech recognition kneepoint K and/or the sound pressure level threshold SPLT may be frequency-dependent. For example, the upper speech recognition kneepoint K and/or the sound pressure level threshold SPLT may be stored for different frequencies in the hearing device 10. In this case, the attenuation of the sound signal 42 may be performed frequency-dependent. The input sound pressure level 32 may be determined for a plurality of frequency bands and the attenuation may be performed based on the input sound pressure level 32 for the respective frequency bands.

Additionally, the sound signal 42 may be frequency lowered, compressed and/or translated above the upper speech recognition kneepoint K. For example, output limiting, frequency lowering/compression/translation and/or other sound programs may be activated above the sound pressure level threshold SPLT. Such sound programs may include noise reduction, monaural or binaural beamforming, and/or dereverberation.

In step S14, the attenuated sound signal 44 is output with a loudspeaker 22 of the hearing device 10 to the ear of the user.

Optionally, a strength of a middle ear muscle reflex may be measured by generating sound with the loudspeaker 22 of the hearing device 10 at different sound pressure levels 30. The sound then may be transmitted in the ear of the user and reflected there. The reflected sound signal may be received and a sound pressure level of the reflected signal may be evaluated to determine a curve, such as the speech intelligibility curve 36.

Also, a wideband middle ear muscle reflex strength may be measured using ipsilateral or contralateral broadband noise reflex elicitors and narrowband noise reflex elicitors or tonal reflex elicitors of varying center frequency. If the middle ear muscle reflex strength is weaker than normal for one elicitor frequency or for a cluster of frequencies, frequency lowering and/or frequency compression and/or frequency translation is activated to present the information contained in these frequency bands at frequencies of normal middle ear muscle reflex strength. The middle ear muscle reflex tuned frequency lowering/compression/translation may only be activated in time-frequency audio frames, whose level estimate exceeds the frequency-dependent sound pressure level threshold SPLT.

A further possibility for adjusting the attenuation of the sound pressure level may be based on a noise exposure index. The noise exposure index may be determined from a self-report of the user, who may fill out a questionnaire or complete a structured interview with a hearing-care professional. The noise exposure index may be used to adjust the parameters as described above, such as the parameters K, T, CR, dynamic-range compression time constants, noise reduction strength, beamforming strength, and/or dereverberation strength. With increasing individual past noise exposure, a strength of attenuation may increase from milder to more aggressive sound processing.

For example, the parameter K could be additively adjusted by an individual adjustment KN, such as 5 dB, for noise exposure exceeding a pre-defined noise exposure threshold, resulting in K'=K−KN.

Also, a tinnitus severity index may be used instead and/or additionally to the noise exposure index. If the user's tinnitus severity exceeds a pre-defined tinnitus severity threshold, then an adjustment value KT, such as KT=5 dB, may be subtracted from the parameter K, resulting K'=K−KT.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing device
12 behind the ear part
14 coupling
16 tube
18 microphone
20 sound processor
22 sound output device, loudspeaker
24 processor
26 knob
28 memory
30 output sound pressure level
32 input sound pressure level
34 speech score
36 speech intelligibility curve
38 attenuation curve
40 unmodified attenuation curve
42 input sound signal
44 output sound signal
K speech recognition kneepoint
SPLT sound pressure level threshold
MEIL maximum expected input level/maximal sound pressure level

What is claimed is:

1. A method for compensating hearing deficiencies with a hearing device, the method comprising:
receiving a sound signal;
attenuating an output sound pressure level of the sound signal dependent on an input sound pressure level of the sound signal; and
outputting the attenuated sound signal with a loudspeaker of the hearing device;
wherein:
the output sound pressure level is attenuated, when the input sound pressure level is above an upper speech recognition kneepoint of a user, which upper speech recognition kneepoint is stored in the hearing device and which has been selected dependent on a sound pressure level dependent speech recognition ability of the user;
the upper speech recognition kneepoint is the lowest sound pressure level at which the user has hearing deficiencies in hearing speech; and
the upper speech recognition kneepoint is higher than 75 dB.

2. The method of claim 1, wherein the output sound pressure level is attenuated above a sound pressure level threshold, which sound pressure level threshold is stored in the hearing device and which has been selected smaller than the upper speech recognition kneepoint.

3. The method of claim 2, wherein an attenuation of the output sound pressure level between the sound pressure level threshold and the upper speech recognition kneepoint is continuously increasing.

4. The method of claim 2, wherein the sound signal at a maximal sound pressure level is attenuated to the upper speech recognition kneepoint.

5. The method of claim 2, wherein, below the sound pressure level threshold, the output sound signal is attenuated by at least 10%; or wherein an attenuation factor of the output sound signal below the sound pressure level threshold is equal to 1.

6. The method of claim 1, wherein the upper speech recognition kneepoint is higher than 85 dB.

7. The method of claim 1,
wherein the upper speech recognition kneepoint is frequency-dependent;
wherein the upper speech recognition kneepoint is stored for different frequencies in the hearing device.

8. The method of claim 7, wherein the attenuation of the sound signal is additionally frequency-dependent.

9. The method of claim 1, wherein the sound signal is at least one of frequency lowered, compressed, or translated above the upper speech recognition kneepoint.

10. The method of claim 1, further comprising:
measuring a strength of a middle ear muscle reflex; and
adjusting at least one of frequency lowering, frequency compression, or frequency translation dependent on the measured strength of the middle ear muscle reflex;
wherein the middle ear muscle reflex is measured by generating sound with a loudspeaker of the hearing device at different sound pressure levels, which is transmitted in the ear of the user, receiving a reflected sound signal reflected by the ear, and evaluating a sound pressure level of the reflected sound signal.

11. The method of claim 1,
wherein the received sound signal at least one of
is generated by a microphone of the hearing device; or
encodes environmental sound of the user.

12. A non-transitory computer-readable medium storing a computer program for compensating hearing deficiencies with a hearing device, which, when being executed by a processor, is adapted to perform the method of claim 1.

13. A hearing device, comprising:

a microphone for acquiring environmental sound of the user and for generating the sound signal;

a sound processor for attenuating the sound signal at least dependent on the input sound pressure level of the sound signal;

a loudspeaker for outputting the attenuated sound signal to the user;

wherein the hearing device is adapted for performing the method of claim 1.

* * * * *